US008481234B2

(12) United States Patent
Li et al.

(10) Patent No.: US 8,481,234 B2
(45) Date of Patent: Jul. 9, 2013

(54) IMAGE BEARING MEMBER

(75) Inventors: Hongguo Li, Shizuoka (JP); Kazukiyo Nagai, Shizuoka (JP); Yoshiaki Kawasaki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 58 days.

(21) Appl. No.: 13/226,711

(22) Filed: Sep. 7, 2011

(65) Prior Publication Data

US 2012/0064444 A1 Mar. 15, 2012

(30) Foreign Application Priority Data

Sep. 9, 2010 (JP) ..... 2010-201595

(51) Int. Cl.
*G03G 5/06* (2006.01)

(52) U.S. Cl.
USPC ..... 430/58.35; 430/58.65; 430/66; 430/75

(58) Field of Classification Search
USPC ..... 430/58.35, 58.65, 66, 75
See application file for complete search history.

(56) References Cited

U.S. PATENT DOCUMENTS

| | | | | |
|---|---|---|---|---|
| 6,849,367 | B2 | 2/2005 | Shoshi et al. | |
| 6,939,651 | B2 | 9/2005 | Li et al. | |
| 7,175,958 | B2 | 2/2007 | Shoshi et al. | |
| 7,507,509 | B2 | 3/2009 | Nagai et al. | |
| 2010/0227264 | A1 | 9/2010 | Kawasaki et al. | |
| 2010/0260513 | A1 | 10/2010 | Kawasaki et al. | |
| 2012/0171601 | A1 * | 7/2012 | Li et al. | 430/58.05 |

FOREIGN PATENT DOCUMENTS

| | | | |
|---|---|---|---|
| JP | 58-32372 | | 7/1983 |
| JP | 58-190953 | | 11/1983 |
| JP | 7-128877 | | 5/1995 |
| JP | 10142821 | A * | 5/1998 |
| JP | 2994092 | | 10/1999 |
| JP | 2994093 | | 10/1999 |
| JP | 3035622 | | 2/2000 |
| JP | 2007140357 | A * | 6/2007 |

* cited by examiner

*Primary Examiner* — Christopher Rodee
(74) *Attorney, Agent, or Firm* — Cooper & Dunham LLP

(57) ABSTRACT

An image bearing member including an electroconductive substrate, a photosensitive layer provided overlying the electroconductive substrate, and a furan derivative represented by the following chemical structure 1, Chemical structure 1 where $Ar_1$ and $Ar_2$ independently represent substituted or non-substituted aryl groups and $R_1$ represents an alkylene group having one to six carbon atoms.

6 Claims, 2 Drawing Sheets

IMAGE BEARING MEMBER

CROSS-REFERENCE TO RELATED APPLICATIONS

This patent application is based on and claims priority pursuant to 35 U.S.C. §119 to Japanese Patent Application No. 2010-201595, filed on Sep. 9, 2010, in the Japan Patent Office, the entire disclosure of which is hereby incorporated herein by reference.

BACKGROUND OF THE INVENTION

1. Field of the Invention

The present invention relates to an image bearing member for use in electrophotography.

2. Description of the Background Art

An image forming method using an image bearing member used in photocopiers, facsimile machines, laser printers, direct digital plate makers, etc., includes at least the following processes: charging the image bearing member; irradiating the image bearing member with light to form a latent electrostatic image; developing the latent image with toner to obtain a visual toner image; transferring the toner image to an image carrying body (a transfer medium, typically paper); fixing the toner image; and cleaning the surface of the image bearing member.

Typically, known image bearing members for use in electrophotography have a photoconductive layer mainly made of selenium or an alloy thereof on an electroconductive substrate, or use inorganic photoconductive material such as zinc oxide and cadmium sulfide dispersed in a binder resin or an amorphous silicon-based material. In recent years, organic photoreceptors have come to be widely used because of their inexpensiveness, superior photoreceptor design flexibility, environmental cleanliness, etc.

Organic photoreceptors are classified into several general types: photoconductive resin, typified by polyvinylcarbazole (PVK); charge transfer complex typified by PVK-TNF (2,4,7-trinitrofluorenone); pigment dispersion typified by phthalocyanine-binder; and function separation using a combination of a charge generation material and a charge transport material. Among these, image bearing members of the function separation type are the most appealing.

The mechanism of electrostatic image formation in a function separation type photoreceptor (image bearing member) involves charging the image bearing member and then irradiating the image bearing member with light. The light passes through a transparent charge transport layer and is absorbed by a charge generation material in a charge generation layer, with the charge generation material that has absorbed light generating a charge carrier. The charge carrier is infused into the charge transport layer and is transported through the charge transport layer by an electric field generated by the charging, neutralizing the charge on the surface of the image bearing member to form a latent electrostatic image. In the function separation type image bearing member, a combination of a charge transport material absorbing mainly the ultraviolet and a charge generation material absorbing mainly visible light is known to be useful.

Most of the charge transport materials developed for the organic photoreceptor for use in electrophotography are low molecular weight compounds. Since such low molecular weight compounds do not have a layer forming property independently, these are typically dispersed and/or mixed in an inert polymer. Various charge transport materials have been developed.

Specific examples thereof include, but are not limited to, α-phenylstilbene derivative (as in Japanese patent application publication no. S58-190953 (JP-S58-190953-A), triphenylamine derivative (JP-H03-285960-A), and benzidine derivative (Japanese patent examined publication no. S58-32372 (JP-S58-32372-B). However, these charge transport materials are highly crystalline, thereby failing to impart sufficient solvent cracking resistance to the image bearing member.

At the same time, various methods have been proposed to prevent solvent cracking of the image bearing member. For example, JP-H04-368954-A describes adding a silicon-based graft polymer to the charge transport layer. JP-H04-368956-A describes setting the viscosity average molecular weight of a polycarbonate of from $2.5\times10^4$ to $15\times10^4$. JP-H07-128877-A describes setting the amount of residual solvent in the charge transport layer at 30 to 500 ppm.

These approaches are successful to some degree in preventing solvent cracking. However, these are combinations of a binder resin and a solvent and have no impact on the crystalline property of the charge transport material, which causes a problem of maintaining the anti-solvent cracking property.

SUMMARY OF THE INVENTION

In view of the foregoing, the present invention provides a novel image bearing member which includes an electroconductive substrate, a photosensitive layer provided overlying the electroconductive substrate, and a furan derivative represented by the following chemical structure 1, Chemical structure 1

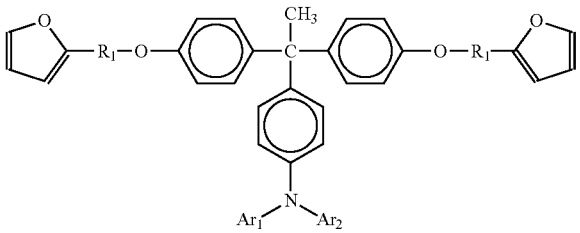

where $Ar_1$ and $Ar_2$ independently represent substituted or non-substituted aryl groups and $R_1$ represents an alkylene group having one to six carbon atoms.

It is preferred that, in the image bearing member mentioned above, the furan derivative is contained in the photosensitive layer.

It is still further preferred that the image bearing member further includes a surface layer provided overlying the photosensitive layer, wherein the furan derivative is contained in the surface layer.

It is still further preferred that, in the image bearing member mentioned above, the furan derivative is represented by the following chemical structure 2, Chemical structure 2

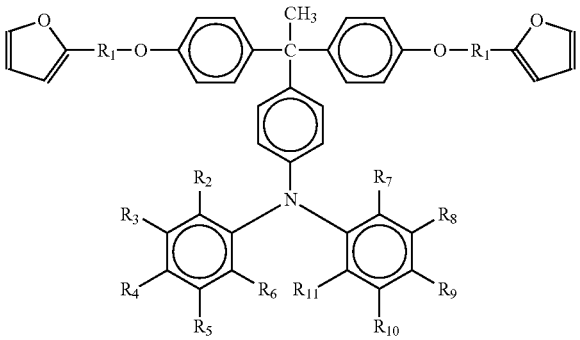

where $R_2$ to $R_{11}$ independently represent substituted or non-substituted alkyl groups having one to six carbon atoms, substituted or non-substituted alkoxy groups having one to six carbon atoms, or substituted or non-substituted aryl groups.

It is still further preferred that, in the image bearing member mentioned above, the furan derivative is represented by the following chemical structure 3, Chemical structure 3

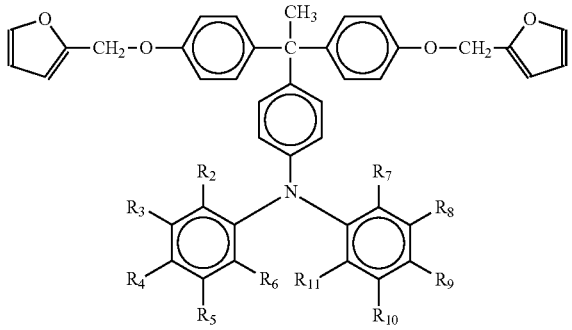

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE PRESENT DISCLOSURE

Figure 1A:
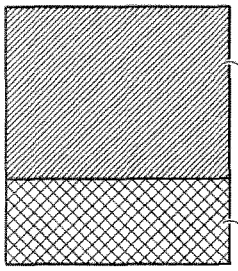
FIGS. 1A and 1B are diagrams illustrating schematic cross sections of examples of the image bearing member having a single layer structure of the present disclosure.

The present disclosure is described in detail with reference to accompanying drawings. First, the furan derivative for use in the present disclosure is described in detail.

Although no detail mechanism is clear yet, it is inferred that since the charge transport furan derivative in the present disclosure is formed by introducing a furan group having a unique structure, the derivative is not crystallized in a binder resin due to the steric barrier function, thereby improving the solvent cracking durability. In addition, the furan group does not have an adverse impact on the charge transport property so that an obtained image bearing member has excellent electric characteristics and solvent cracking durability.

Therefore, in the present disclosure, an image bearing member is provided which has a furan derivative represented by the following chemical structure 1, 2, or 3 and thus has excellent hole transport property and solvent cracking durability. It is preferable that the image bearing member contains the furan derivative in the surface layer (e.g., the photosensitive layer) thereof Chemical structure 1

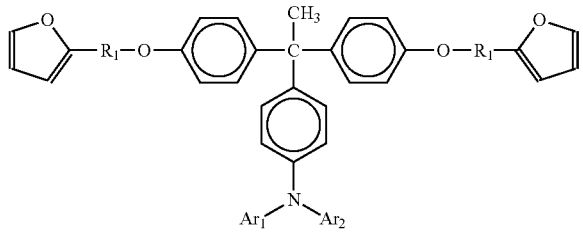

where $Ar_1$ and $Ar_2$ independently represent substituted or non-substituted aryl groups and $R_1$ represents an alkylene group having one to six carbon atoms.

Chemical structure 2

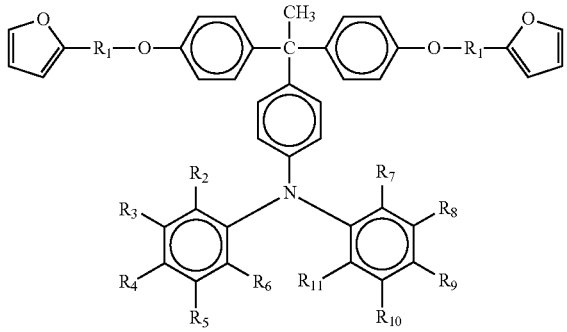

wherein $R_2$ to $R_{11}$ independently represent substituted or non-substituted alkyl groups having one to six carbon atoms, substituted or non-substituted alkoxy groups having one to six carbon atoms, or substituted or non-substituted aryl groups.

Chemical structure 3

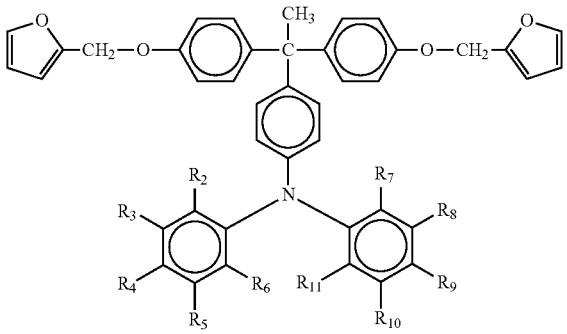

In the chemical structures 1 and 2, $R_1$ represents an alkylene group having one to six carbon atoms and preferably a methylene group.

$Ar_1$ and $Ar_2$ in the chemical structure 1 independently represent substituted or non-substituted aryl groups. Specific examples thereof include, but are not limited to, phenyl groups, naphtyl groups, biphenyl groups, terphenyl groups, pyrenyl groups, fluorenyl groups, 9,9-dimethyl-2-fluorenyl groups, azulenyl groups, anthryl groups, triphenylenyl groups, crysenyl groups, and groups represented by the chemical structures 4 to 7.

Chemical Structure 4

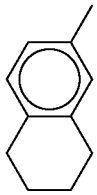

Chemical structure 5

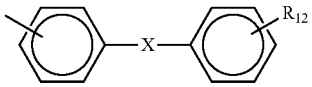

In the chemical structure 5, X represents —O—, —S—, —SO—, $—SO_2$, —CO—, and the following bifunctional groups. $R_{12}$ represents a hydrogen atom, a halogen atom, a substituted or non-substituted alkyl group, and a substituted or non-substituted aryl group.

Chemical structure 6

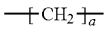

In the chemical structure 6, a symbol "a" represents an integer of from 1 to 12.

Chemical structure 7

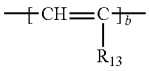

In the chemical structure 7, a symbol "b" represents an integer of from 1 to 3 and $R_{13}$ represents a hydrogen atom, a halogen atom, a substituted or non-substituted alkyl group, and a substituted or non-substituted aryl group.

Specific examples of these substitution groups include, but are not limited to, a halogen atom, a substituted or non-substituted alkyl group having one to six carbon atoms, and a substituted or non-substituted alkoxy group. Specific examples of the halogen atoms include, but are not limited to, a fluorine atom, a chlorine atom, a bromine atom, and an iodine atom.

In addition, specific examples of the substitution groups of the alkyl groups having one to six carbon atoms include, but are not limited to, a halogen atom and a phenyl group. The substituted or non-substituted alkoxy group represents the alkoxy group specified above having a substituted or non-substituted alkyl group having one to six carbon atoms. Specific examples thereof include, but are not limited to, a methoxy group, an ethoxy group, an n-propoxy group, an i-propoxy group, a t-buthoxy group, an n-buthoxy group, and a benzyloxy group.

In addition, $R_2$ to $R_{11}$ independently represent a substituted or non-substituted alkyl group having one to six carbon atoms, a substituted or non-substituted alkoxy group, and a substituted or non-substituted aryl group. Specific examples of the substitution groups of the alkyl groups having one to six carbon atoms include, but are not limited to, a halogen atom and a phenyl group. Specific examples of the substituted or non-substituted alkyl group having one to six carbon atoms include, but are not limited to, a methyl group, an ethyl group, an n-propyl group, an i-propyl group, a t-butyl group, an s-butyl group, an n-butyl group, an i-butyl group, an n-pentyl group, an n-hexyl group, a cyclohexyl group, a trifluoromethyl group, a benzyl group, a 4-chlorobenzyl group, and 4-methyl benzyl group.

The alkoxy group represents an alkoxy group having an alkyl group having one to six carbon atoms which may have the substitution groups specified above. Specific examples thereof include, but are not limited to, a methoxy group, an ethoxy group, an n-propoxy group, an i-propoxy group, a t-buthoxy group, an n-buthoxy group, and benzyloxy group.

Specific examples of the aryl group include, but are not limited to, a phenyl group, a naphtyl group, a biphenyl group, a terphenyl group, a pyrenyl group, a fluorenyl group, a 9,9-dimethyl-2-fluorenyl group, an azulenyl group, an anthryl group, a triphenylenyl group, and a crysenyl group.

Specific examples of these substitution groups include, but are not limited to, a halogen atom and an alkyl group having one to six carbon atoms. The halogen atom and the alkyl group having one to six carbon atoms are the identical to those specified above.

Specific examples of the furan derivative of the present disclosure are as follows:

No. 1

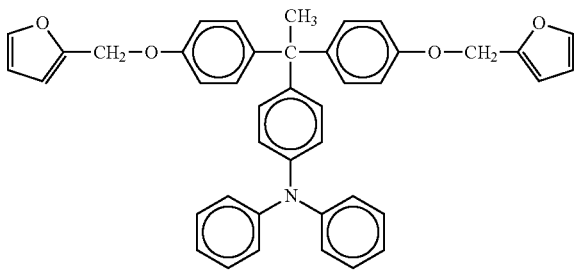

-continued
No. 2
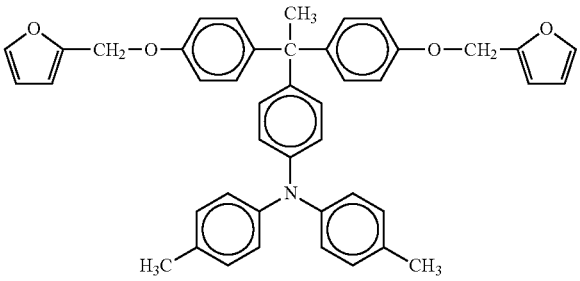
No.3
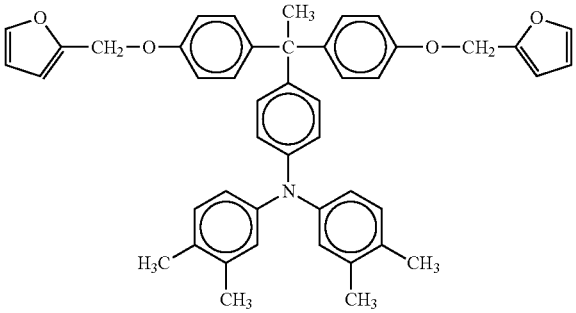
No. 4
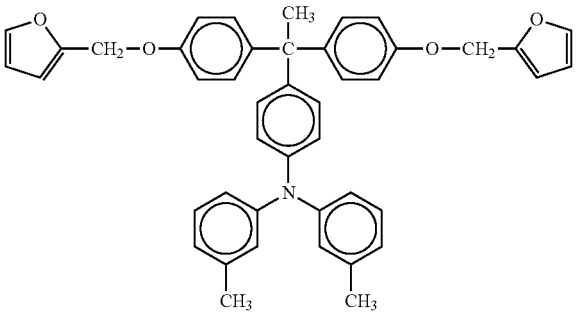
No. 5
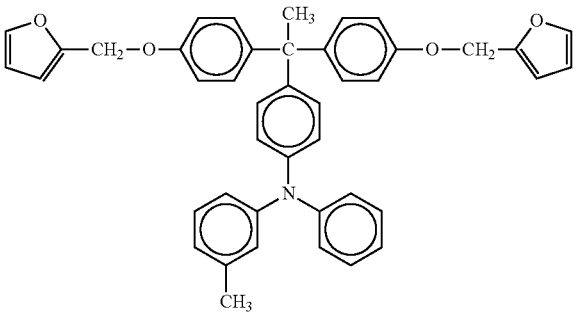
No. 6
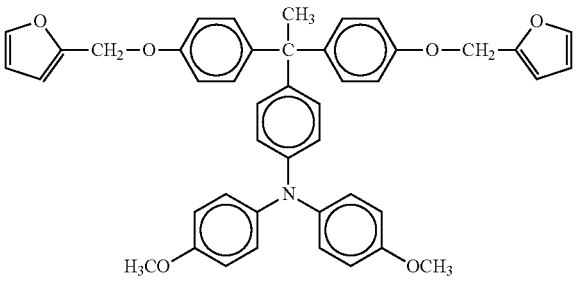
-continued
No. 7
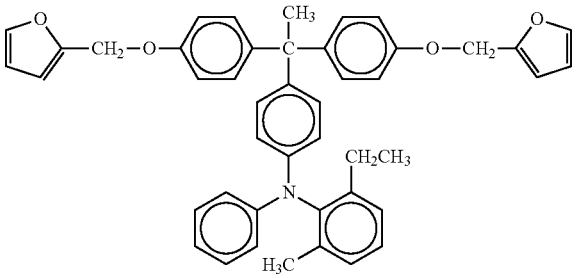
No. 8
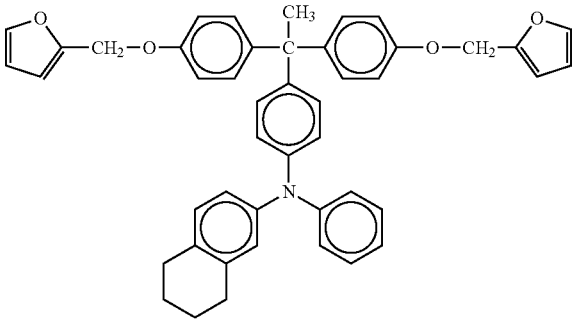
No. 9
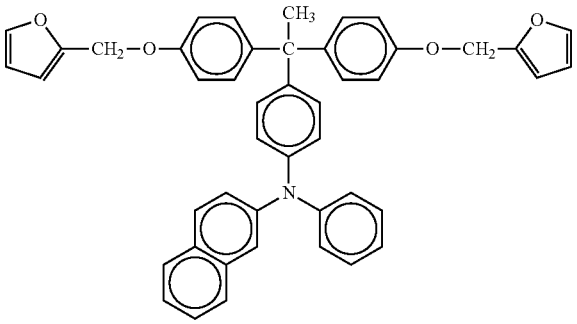
No. 10
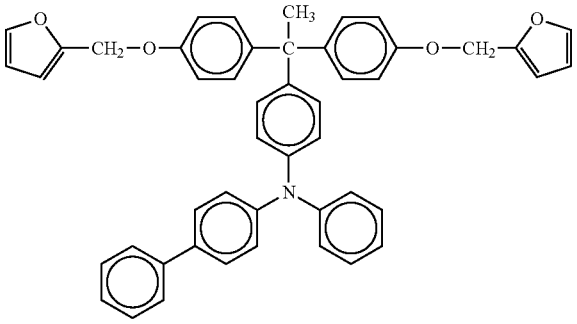

-continued
No. 11
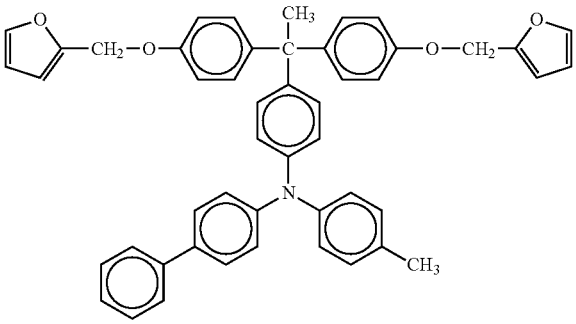
No. 12
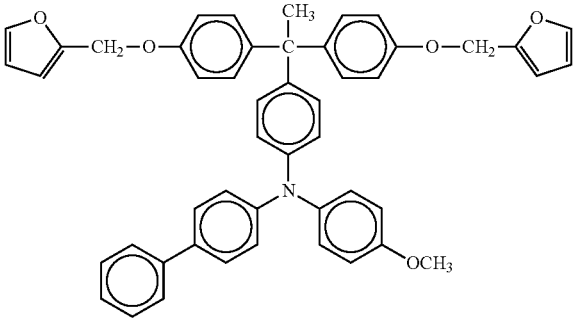
No. 13
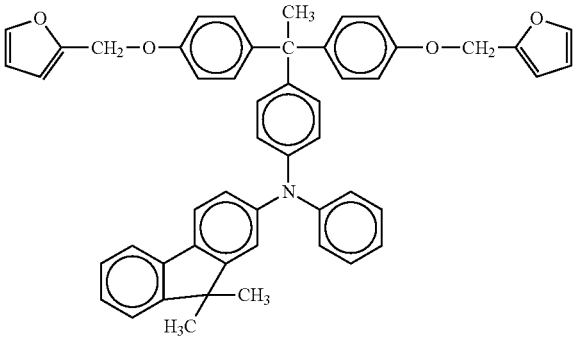
No. 14
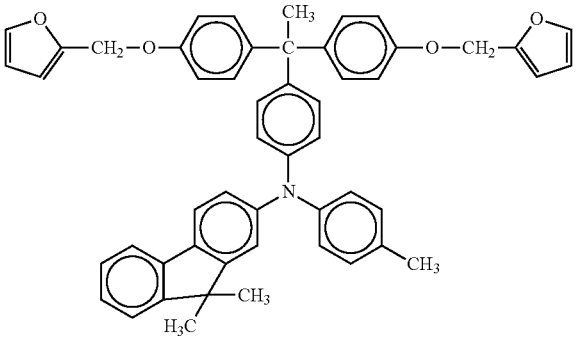
-continued
No. 15
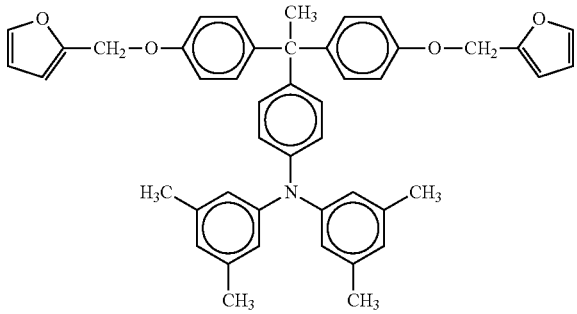
No. 16
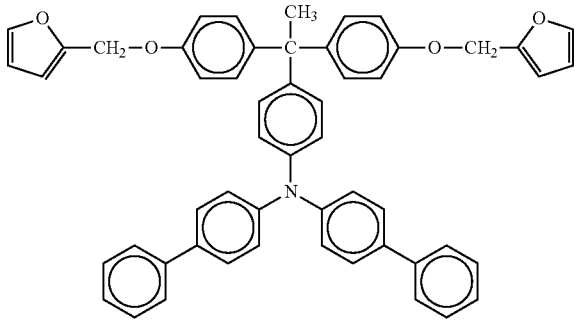
No. 17
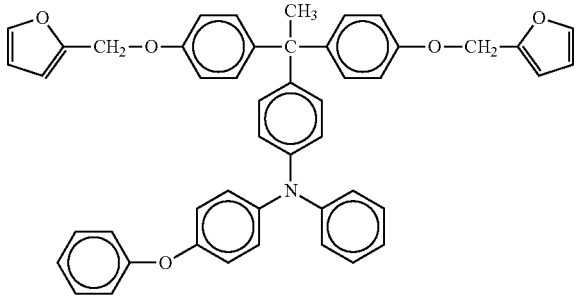
In the present disclosure, the furan derivative contained in the image bearing member, preferably the surface layer (e.g., the photosensitive layer) is a new compound and can be easily manufactured by, for example, the following chemical reaction I (Mitsunobu reaction).
Chemical Reaction I
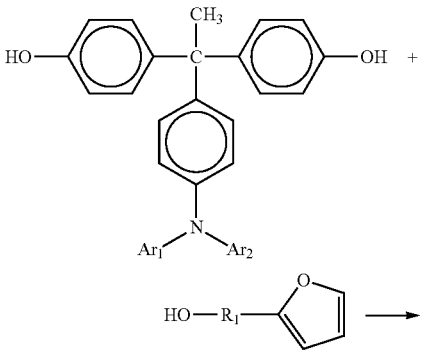

-continued

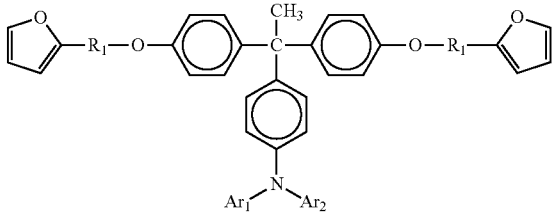

In the present disclosure, the furan derivative contained in the image bearing member (preferably the surface layer, e.g. the photosensitive layer) is manufactured by conducting dehydration condensation of an alcohol and a dihpenol derivative in the presence of an azodicarbaoxylic acid ester and a triphenyl phosphine serving as catalysts.

Such an azodicarbaoxylic acid ester and a triphenyl phosphine are commercially available.

Specific examples of the azodicarbaoxylic acid ester include, but are not limited to, 1,1'-(azodicarbonyl)dipiperidine, azodicarboxylic acid di-tert-butyl, azodicarboxylic acid dibenzyl, azodicarboxylic acid ester, azodicarboxylic acid diisopropyl, and azodicarboxylic acid dimethyl. Specific examples of the triphenyl phosphine include, but are not limited to, 4-(dimethylamino)phenyl diphenylphosphine, dicyclohexylphenylphosphine, diethylphenyl phosphine, diphenyl-2-pyridyl phosphine, isopropyl diphenyl phosphine, phenoxy diphenyl phosphine, tri-n-octylphosphine, tri-tert-butyl phosphine, tributyl phosphine, tricyclohexyl phosphine, tri-n-hexyl phosphine, and triphenyl phosphine.

Such an alcohol can be synthesized or is commercially available. A specific example thereof is furfuryl alcohol.

With regard to the diphenol derivative, known compounds and known synthesis methods can be used.

Specific examples of the solvent include, but are not limited to, pyridine, triethylamine, tetrahydrofuran, 2-methyl tetrahydrofuran, dimethyl formamide, diethylether, dimethyl sulfoxide, dichloromethane, and chloroform, and toluene.

The reaction temperature ranges from −5° C. to the boiling point of the solvent and preferably from 0° C. to room temperature. Furthermore, it is preferable to conduct the reaction in an atmosphere of an inert gas such as argon.

The reaction typically completes in one hour to 24 hours.

The furan derivative for use in the image bearing member of the present disclosure has been described above. Embodiments in which the furan derivative is contained in the surface layer (e.g., the photosensitive layer) of an image bearing member are described below referring to the layer structure of the image bearing member.

Layer Structure of Image Bearing Member

The image bearing member of the present disclosure is described with reference to the accompanying drawings.

FIG. 1 is a diagram illustrating a cross section of an example of the image bearing member of the present disclosure, which has a single-layered photosensitive layer having a charge generation function and a charge transport function simultaneously provided on an electroconductive substrate. FIG. 1A is a diagram illustrating a layer structure of an image bearing member in which the surface layer having the furan derivative of the present disclosure is the entire of the photosensitive layer. The surface layer contains at least a charge generation material, the furan derivative of the present disclosure, and a binder resin.

Figure 1B:
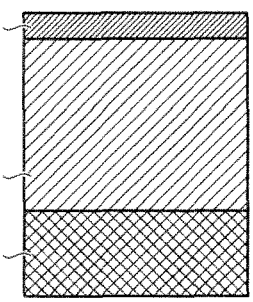

FIG. 1B is a diagram illustrating a layer structure of an image bearing member in which the surface layer having the furan derivative is provided on the photosensitive layer, in which the photosensitive layer contains at least a charge generation material, a charge transport material, and a binder resin and the surface layer contains at least a charge transport layer, the furan derivative of the present disclosure, and a binder resin.

FIG. 2 is a diagram illustrating an image bearing member having an electroconductive substrate on which a photosensitive layer having a laminate structure is provided. The photosensitive layer has a charge generation layer having a charge generation function and a charge transport layer having a charge transport function placed on the charge generation layer.

Figure 2A:
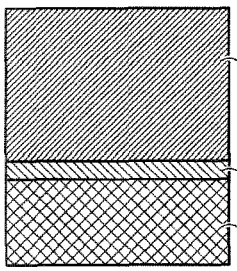
FIGS. 2A and 2B are diagrams illustrating schematic cross sections of examples of the image bearing member having a laminate structure of the present disclosure.

FIG. 2A is a diagram illustrating a layer structure of an image bearing member in which the surface layer having the furan derivative for use in the present disclosure is the entire of the charge transport layer. The surface layer contains at least the furan derivative and a binder resin.

Figure 2B:
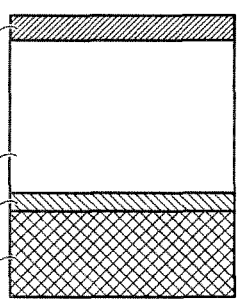

FIG. 2B is a diagram illustrating the layer structure of an image bearing member in which the surface layer having the furan derivative is provided on the charge transport layer, in which the charge transport layer contains at least a charge transport material and a binder resin and the surface layer on the charge transport layer contains at least the furan derivative for use in the present disclosure and a binder resin.

Electroconductive Substrate

The electroconductive substrate can be formed by using a material having a volume resistance of not greater than $10^{10}$ Ω·cm. For example, there can be used plastic or paper having a film form or cylindrical form covered with metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Furthermore, a tube which is manufactured from the board mentioned above by a crafting technique such as extruding and extracting and surface-treatment such as cutting, super finishing, and grinding is also usable.

In addition, an endless nickel belt and an endless stainless belt described in JP-S52-36016-A can be used as the electroconductive substrate.

An electroconductive substrate formed by applying to the substrate mentioned above a liquid application in which electroconductive powder is dispersed in a suitable binder resin can be used as the electroconductive substrate for use in the present disclosure.

Specific examples of such electroconductive powder include, but are not limited to, carbon black, acetylene black, metal powder, such as powder of aluminum, nickel, iron, nichrome, copper, zinc and silver, and metal oxide powder, such as electroconductive tin oxide powder and ITO powder.

Specific examples of the binder resins which are used together with the electroconductive powder include, but are not limited to, thermoplastic resins, thermosetting resins, and optical curing resins, such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, a urethane resin, a phenolic resin, and an alkyd resin.

Such an electroconductive layer can be formed by dispersing the electroconductive powder and the binder resins mentioned above in a suitable solvent, for example, tetrahydrofuran (THF), 2-methyltetrahydrofuran, dichloromethane (MDC), methyl ethyl ketone (MEK), and toluene and applying the resultant to an electroconductive substrate.

In addition, an electroconductive substrate formed by providing a heat contraction tube as an electroconductive layer on a suitable cylindrical substrate can be suitably used as the electroconductive substrate of the present disclosure. The heat contraction tube is formed of material such as polyvinyl chloride, polypropylene, polyester, polystyrene, polyvinylidene chloride, polyethylene, chloride rubber, and TEFLON®, which includes the electroconductive powder mentioned above.

Photosensitive Layer

Next, the photosensitive layer is described. The photosensitive layer has a single layer structure or a laminate structure.

In the case of the laminate structure, the photosensitive layer is formed of a charge generation layer having a charge generation function and a charge transport layer having a charge transport function. In the case of the single layer structure, the photosensitive layer has a charge generation function and a charge transport function simultaneously.

The photosensitive layer having a laminate structure and the photosensitive layer having a single layer structure are described separately.

Photosensitive Layer Having Laminate Structure

Charge Generation Layer

The charge generation layer is mainly formed of a charge generation material having a charge generation function and an optional binder resin. Inorganic material and organic material can be used as the charge generating material.

Specific examples of the inorganic materials include, but are not limited to, crystal selenium, amorphous-selenium, selenium-tellurium-halogen, selenium-arsenic compounds, and amorphous-silicon. With regard to the amorphous-silicon, those in which a dangling-bond is terminated with a hydrogen atom or a halogen atom, and those in which boron atoms or phosphorous atoms are doped are preferably used.

As for the organic material, any known material in the art can be used.

Specific examples thereof include, but are not limited to, phthalocyanine pigments, for example, metal phthalocyanine and metal-free phthalocyanine; azulenium salt pigments; squaric acid methine pigments; azo pigments having a carbazole skeleton; azo pigments having a triphenylamine skeleton; azo pigments having a diphenylamine skeleton; azo pigments having a dibenzothiophene skeleton; azo pigments having a fluorenone skeleton; azo pigments having an oxadiazole skeleton; azo pigments having a bis-stilbene skeleton; azo pigments having a distyryloxadiazole skeleton; azo pigments having a distyrylcarbazole skeleton; perylene pigments, anthraquinone or polycyclic quinone pigments; quinoneimine pigments; diphenylmethane and triphenylmethane pigments; benzoquinone and naphthoquinone pigments; cyanine and azomethine pigments, indigoid pigments, and bis-benzimidazole pigments. These charge generation materials may be used alone or in combination.

Specific examples of the binder resin optionally used in the charge generation layer include, but are not limited to, polyamides, polyurethanes, epoxy resins, polyketones, polycarbonates, silicone resins, acrylic resins, polyvinylbutyrals, polyvinylformals, polyvinylketones, polystyrenes, poly-N-vinylcarbazoles, and polyacrylamides.

These binder resins may be used alone or may be used as a mixture of two or more. In addition to the binder resins specified above for the charge generation layer, a polymerizable charge transport material having a charge transport function, for example, a polycarbonate resin, a polyester resin, a polyurethane resin, a polyether resin, a polysiloxane resin, or an acrylic resin having an arylamine skeleton, a benzidine skeleton, a hydrazone skeleton, a carbazole skeleton, a stilbene skeleton, or a pyrazoline skeleton; and a polymerizable material having a polysilane skeleton, can be also used.

Specific examples of the former charge transport polymers include, but are not limited to, compounds described in JPs H01-001728-A, H01-009964-A, H01-013061-A, H01-019049-A, H01-241559-A, H04-011627-A, H04-175337-A, H04-183719-A, H04-225014-A, H04-230767-A, H04-320420-A, H05-232727-A, H05-310904-A, H06-234836-A, H06-234837-A, H06-234838-A, H06-234839-A, H06-234840-A, H06-234840-A, H06-234841-A, H06-239049-A, H06-236050-A, H06-236051-A, H06-295077-A, H07-056374-A, H08-176293-A, H08-208820-A, H08-211640-A, H08-253568-A, H08-269183-A, H09-062019-A, H09-043883-A, H09-71642-A, H09-87376-A, H09-104746-A, H09-110974-A, H09-110974-A, H09-110976-A, H09-157378-A, H09-221544-A, H09-227669-A, H09-221544-A, H09-227669-A, H09-235367-A, H09-241369-A, H09-268226-A, H09-272735-A, H09-272735-A, H09-302084-A, H09-302085-A, and H09-328539-A.

Specific examples of the latter charge transport polymers include, but are not limited to, polysiylene polymers described in JPs S63-285552-A, H05-19497-A, H05-70595-A, and H10-73944-A.

The charge generation layer optionally contains a charge transport material having a low molecular weight.

The charge transport material having a low molecular weight which can be used in combination in the charge generation layer is classified into positive hole transport materials and electron transport materials.

Specific examples of such electron transport materials include, but are not limited to, electron acceptance materials such as chloranil, bromanil, tetracyano ethylene, tetracyanoquino dimethane, 2,4,7-trinitro-9-fluorenone, 2,4,5,7-tetranitro-9-fluorenone, 2,4,5,7-tetranitroxanthone, 2,4,8-trinitro thioxanthone, 2,6,8-trinitro-4H-indeno[1,2-b]thiophene-4-one, 1,3,7-trinitrodibenzo thiophene-5,5-dioxide, and diphenoquinone derivatives. These charge transport materials can be used alone or in combination.

The following electron donating materials can be suitably used as the positive hole transport materials.

Specific examples of such positive hole transport materials include, but are not limited to, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, enamine derivatives, and other known materials. These positive hole transport materials can be used alone or in combination.

The charge generation layer is typically manufactured by a vacuum thin layer formation method or a casting method using a liquid dispersion system.

Specific examples of the vacuum thin layer formation methods include, but are not limited to, a vacuum deposition method, a glow discharge decomposition method, an ion-plating method, a sputtering method, a reactive sputtering method, and a CVD method. The inorganic materials and organic materials specified above can be suitably used in these methods.

In the casting method, the above-mentioned inorganic or organic charge generation materials are dispersed with an optional binder resin in a solvent, for example, tetrahydrofuran, 2-methyltetrahydrofuran, dioxane, dioxsolan, toluene, dichloromethane, monochlorobenzene, dichloroethane, cyclohexanone, cyclopentanone, anisole, xylene, methylethylketone, acetone, ethylacetate, butylacetate using, for example, a ball mill, an attritor, a sand mill, or a bead mill. Thereafter, suitably diluted liquid dispersion is applied to the surface of the electroconductive substrate, etc. to form the charge generation layer. Leveling agents such as dimethyl silicone oil and methylphenyl silicone oil can be optionally added.

A dip coating method, a spray coating method, a bead coating method, a ring coating method, etc., can be used for application of the liquid application.

The thickness of the thus provided charge generation layer is suitably from about 0.01 μm to about 5 μm and preferably from 0.05 μm to 2 μm.

Charge Transport Layer

The charge transport layer has a charge transport function and is used as the surface layer that contains the charge transport furan derivative represented by the chemical structure 1, 2, or 3 and a binder resin. When the surface layer is the entire of the charge transport layer, a liquid application containing the furan derivative and the binder resin is applied to the charge generation layer followed by drying to form a surface layer having a charge transport property.

The thickness of the surface layer is suitably from 10 μm to 30 μm and preferably from 10 μm to 25 μm. A surface layer that is excessively thin tends not to be able to maintain a sufficient charging voltage and a surface layer that is excessively thick tends to increase the voltage at bright portions by a residual solvent.

Specific examples of the binder resins contained in the charge transport layer include, but are not limited to, thermoplastic resins or thermosetting resins such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, a polycarbonate, a cellulose acetate resin, an ethyl cellulose resin, a polyvinyl butyral, a polyvinyl formal, a polyvinyl toluene, a poly-N-vinyl carbazole, an acrylic resin, a silicone resin, an epoxy resin, a melamine resin, a urethane resin, a phenolic resin, and an alkyd resin.

The content of the charge transport furan derivative is from 20 to 300 parts by weight and preferably from 40 to 150 parts by weight based on 100 parts by weight of the binder resin.

In the case in which the surface layer having the furan derivative is placed on the charge transport layer, the charge transport layer is formed by applying and drying a liquid application in which a charge transport material having a charge transport function and a binder resin is suitably dissolved and/or dispersed in a solvent to the charge generation layer and a liquid application containing the furan derivative of the present disclosure and a binder resin is applied to the charge transport layer followed by heating to form the surface layer of an image bearing member.

The heating temperature is from 40° C. to 150° C. When the heating temperature is too high, the furan derivative tends to deteriorate. When the heating temperature is too low, the solvent tends to remain in the layer.

The heating temperature preferably ranges from 60 to ° C. 130° C.

The electron transport materials, the positive hole transport materials, and the charge transport polymers specified above in the description about the charge generation layer can be used as the charge transport material. As described above, using a charge transport polymer is particularly suitable in terms of the effect on reduction of the solubility of the charge transport layer when the surface layer is coated.

The content of the charge transport material contained in the transport layer is from 20 to 300 parts by weight and preferably from 40 to 150 parts by weight based on 100 parts by weight of the binder resin. The charge transport polymer can be used alone or in combination with the binder resin.

The content of the furan derivative contained in the surface layer is from 20 to 300 parts by weight and preferably from 40 to 150 parts by weight based on 100 parts by weight of the binder resin.

The same solvent specified for the charge generation layer can be used as the solvent for use in application of the charge transport layer. Solvents that suitably dissolve a charge transport material and a binder resin are good. These solvents can be used alone or in combination. In addition, the same method as in the case of the charge generation layer can be used to form the charge transport layer.

In addition, a plasticizing agent and/or a leveling agent can be added, if desired.

Specific examples of the plasticizing agent for use in the charge transport layer include known resins such as dibutyl phthalate and dioctyl phthalate. The added amount of the plasticizing agent is suitably from 0 to about 30 parts by weight based on 100 parts by weight of the binder resin.

Specific examples of the leveling agent for use in the charge transport layer include, but are not limited to, silicone oils, for example, dimethyl silicone oil and methyl phenyl silicone oil, and polymers or oligomers having perfluoroalkyl groups in its side chain. The added amount of the leveling agent is preferably from 0 to about 1 part by weight based on 100 parts by weight of the binder resin.

The thickness of the charge transport layer is suitably from about 5 μm to about 40 μm and preferably from about 10 μm to about 30 μm.

When the surface layer having the furan derivative is on the charge transport layer, as described in the method of manufacturing the surface layer, a liquid application containing the furan derivative of the present disclosure and the binder resin is applied to the charge transport layer followed by optional drying to form a surface layer having a charge transport property. The thickness of the surface layer is from 1 μm to 20 μm and preferably from 2 μm to 10 μm. When the surface layer is too thin, the layer thickness tends not to be uniform, which leads to non-uniform durability. When the surface layer is too thick, the entire of the charge transport layer tends to have an increased thickness, resulting in deterioration of the reproducibility of images due to diffusion of charges.

Photosensitive Layer Having Single Layer Structure

The photosensitive layer having a single layer structure has a charge transport function and a charge generation function simultaneously and the surface layer that contains the charge transport furan derivative represented by the chemical structure 1, 2, or 3 and a binder resin is used as the photosensitive layer having a single layer structure. As described in the casting method mentioned above for the charge generation layer, a liquid application in which a charge generation material, the furan derivative, and a binder resin are contained is applied to an electroconductive substrate followed by optional drying and heating to form a surface layer having a charge transport function and a charge generation function simultaneously. The thickness of the surface layer is from 10 μm to 30 μm and preferably from 10 μm to 25 μm. A surface layer that is excessively thin tends not to be able to maintain a sufficient charging voltage and a surface layer that is excessively thick tends to raise the voltage at bright portions by a residual solvent.

In the case in which the surface layer having the furan derivative is provided on the photosensitive layer having a single layer structure, the photosensitive layer is formed by applying a liquid application in which a charge generation material having a charge generation function, a charge transport material having a charge transport function, and a binder resin are dissolved and/or dispersed in a suitable solvent to a layer or the substrate provided below the photosensitive layer followed by drying. In addition, a plasticizing agent and/or a leveling agent can be added, if desired. The dispersion method of the charge generation materials, the charge generation materials, the charge transport materials, the plasticizers, and the leveling agents specified above for the charge generation layer and the charge transport layer can be used.

In addition to the binder resins specified for the charge transport layer, mixtures of binder resins specified for the charge generation layer and the binder resins specified for the charge transport layer can be also used.

In addition, the charge transport polymers specified above can be used and are useful in that the photosensitive layer component is prevented from mingling into the surface layer. The thickness of the photosensitive layer is suitably from about 5 μm to about 30 μm and preferably from about 10 μm to about 25 μm.

When the surface layer having the furan derivative is on the photosensitive layer having a single layer structure, as described above, a liquid application containing the furan derivative for use in the present disclosure and the binder resin is applied to the photosensitive layer followed by optional drying to form a surface layer. The thickness of the surface layer is from 1 μm to 20 μm and preferably from 2 μm to 10 μm. When the surface layer is too thin, the durability tends to be non-uniform due to uneven thickness thereof.

The content of the charge generation material contained in the photosensitive layer having a single layer structure is preferably from 1% to 30% by weight, the content of the binder resin contained therein is preferably from 20% to 80% by weight, and the content of the charge transport material contained therein is preferably from 10% to 70% by weight based on the entire amount of the photosensitive layer.

The content of the charge generation material contained in the surface layer containing the furan derivative is preferably from 1% to 30% by weight, the content of the binder resin contained therein is preferably from 20% to 80% by weight, and the content of the charge transport material contained therein is preferably from 10% to 70% by weight based on the entire amount of the surface layer.

In addition, to further improve the electric characteristics, it is preferable to add a charge transport material in the photosensitive layer having a single layer structure. Specific examples of such charge transport materials include, but are not limited to, tetracarboxylic acid derivatives and naphthalene carboxylic acid derivatives.

Undercoating Layer

In the image bearing member (photoreceptor) of the present disclosure, an undercoating layer can be provided between the electroconductive substrate and the photosensitive layer. Typically, such an undercoating layer is mainly made of a resin. Considering that a photosensitive layer is applied to such an undercoating layer (i.e., resin) in a form of solvent, the resin is preferably insoluble in a known organic solvent. Specific examples of such resins include, but are not limited to, water soluble resins, such as polyvinyl alcohol, casein, and sodium polyacrylate, alcohol soluble resins, such as copolymerized nylon and methoxymethylized nylon and curing type resins which form a three dimension mesh structure, such as polyurethane, melamine resins, phenol resins, alkyd-melamine resins, and epoxy resins. In addition, fine powder pigments of metal oxide, such as titanium oxides, silica, alumina, zirconium oxides, tin oxides, and indium oxides can be added to the undercoating layer to prevent occurrence of moiré and reduce the residual voltage.

The undercoating layer described above can be formed by using a suitable solvent and a suitable coating method as described for the photosensitive layer. Silane coupling agents, titanium coupling agents, and chromium coupling agents can be used in the undercoating layer. Furthermore, the undercoating layer can be formed by using a material formed by anodizing $Al_2O_3$, or an organic compound, such as polyparaxylylene (parylene) or an inorganic compound, such as $SiO_2$, $SnO_2$, $TiO_2$, ITO, and $CeO_2$ by a vacuum thin-film forming method. Any other known methods can be also available. The thickness of the undercoating layer is suitably from 0 to 5 nm.

Addition of Anti-Oxidizing Agent to Each Layer

Furthermore, in the present disclosure, an anti-oxidizing agent can be added to each layer, i.e., the surface layer, the charge generation layer, the charge transport layer, the undercoating layer to improve the environmental resistance, in particular, to prevent the degradation of sensitivity and a rise in residual potential.

Specific examples of the anti-oxidizing agent include, but are not limited to, the following:

Phenolic Compounds 2,6-di-t-butyl-p-cresol, butylated hydroxyanisol, 2,6-di-t-butyl-4-ethylphenol, stearyl-β-(3,5-di-t-butyl-4-hydroxyphenyl)propionate, 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, and tocopherols.

Paraphenylene Diamines

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Hydroquinones 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Organic Sulfur Compounds dilauryl-3,3-thiodipropionate, distearyl-3,3'-thiodipropionate, and ditetradecyle-3,3■'-thiodipropionate.

Organic Phosphorous Compounds triphenyl phosphine, tri(nonylphenyl)phosphine, tri(dinonylphenyl)phosphine, tricresyl phosphine, and tri(2,4-dibutylphenoxy)phosphine.

These compounds are known as anti-oxidants for rubber, plastic, and oils and products thereof are easily available in the market.

The added amount of the anti-oxidizing agent in the present disclosure is preferably from 0.01% to 10% by weight based on the total weight of the layer to which the anti-oxidizing agent is added.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples but not limited thereto.

Synthesis Example 1

The following recipe is placed in a reaction container equipped with a stirrer, a thermometer, and a dripping funnel.

Diphenol Derivative Represented by the Following Chemical Structure 8

Chemical structure 8

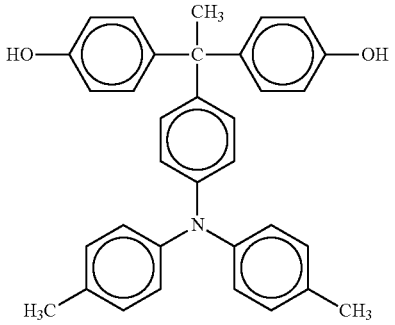

Furfuryl alcohol (manufactured by Tokyo Chemical Industry Co., Ltd.)

Tributylphosphine (manufactured by Tokyo Chemical Industry Co., Ltd.)

Dehydrated dichloromethane 200 ml.

30 ml of dichloromethane solution in which 12.47 g of 1,1'-(azodicarbonyl)dipiperidine (manufactured by Tokyo Chemical Industry Co., Ltd.) is slowly dripped to the reaction container at 1° C. in nitrogen atmosphere to continue the reaction for ten hours at the same temperature. Thereafter, the resultant is filtered and the reaction solvent is removed by an evaporator to obtain a white coarse product. Subsequent to column refinement by silica gel, 4.53 g of the furan derivative (illustrated compound No. 2) of white powder is obtained.

The element analysis is shown below.

| Element Analysis Value (%) | | | |
|---|---|---|---|
| | C | H | N |
| Actual value | 81.83% | 6.09% | 2.17% |
| Calculated value | 81.55% | 6.20% | 1.98% |

Figure 3:
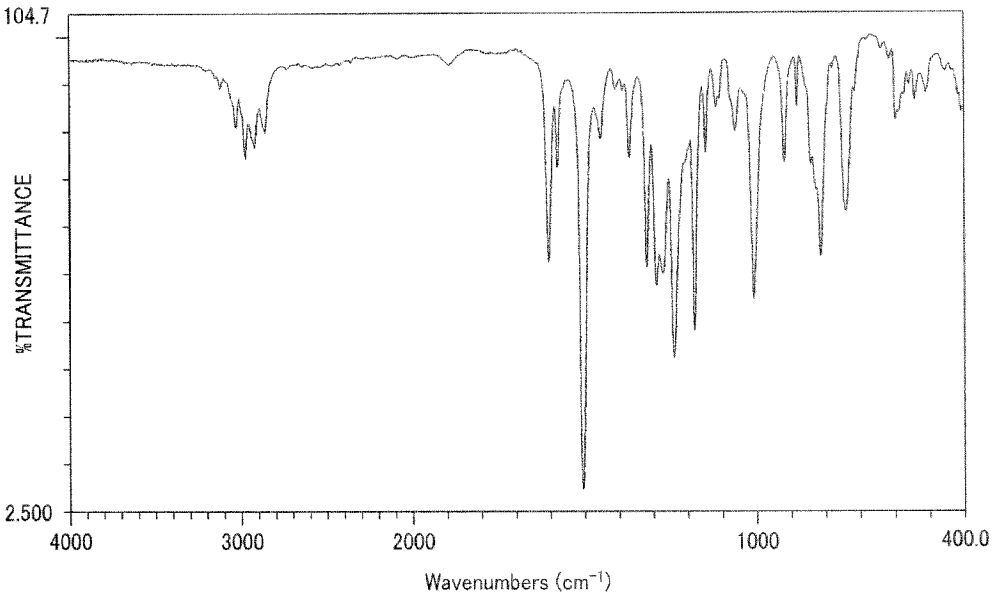
FIG. 3 is a graph illustrating the infrared absorption spectrum (KBR tablet method) of an example of the furan derivative for use in the present disclosure.

FIG. 3 is a graph illustrating the infra-red absorption spectrum (KBr tablet method) of the derivative.

Other illustrated compounds No. 1, No. 5, and No. 9 are synthesized in the same manner.

Example 1

A liquid application having the following recipe is applied to an aluminum substrate (outer diameter: 30 mm Φ) by a dip coating method to form an undercoating layer having a layer thickness of 3.5 μm after drying.

Liquid Application for Undercoating Layer

Alkyd resin (Beckozole 1307-60-EL, manufactured by Dainippon Ink and Chemicals, Inc.)

Melamine resin (Super-beckamine G-821-60, manufactured by Dainippon Ink and Chemicals, Inc.) 4 parts Titanium oxide (CR-EL, manufactured by Ishihara Sangyo Kaisha, Ltd.)

Methylethylketone: 50 parts

Liquid application for charge generation layer containing the bisazo pigment represented by the following chemical structure 9 is applied to the undercoating layer by dip coating followed by heating and drying to form a charge generation layer having a layer thickness of 0.2 μm.

Liquid Application for Charge Generation Layer

Bisazo pigment represented by the following chemical structure 9 2.5 parts

Chemical structure 9

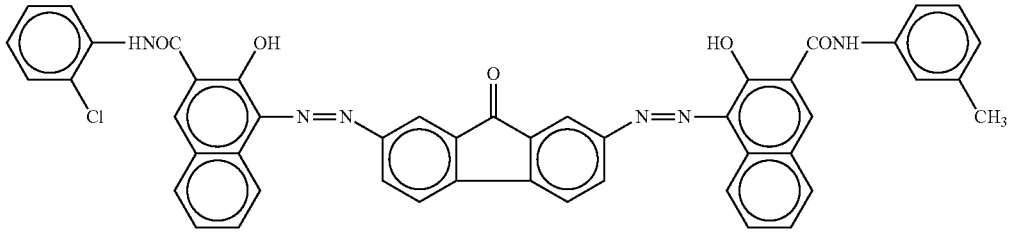

Polyvinyl butyral {XYHL, manufactured by Union Carbide Corporation (UCC)}:

Cyclohexanone 200 parts

Methylethylketone: 80 parts

A liquid application for the surface layer having the following recipe is dip-coated on the charge generation layer to form a layer having a thickness of 25 μm after drying. The layer is processed with heat at 120° C. for 30 minutes to form a transparent surface layer having a charge transport function. The image bearing member 1 of the present disclosure is thus obtained.

Liquid Application for Surface Layer

Furan derivative (Illustrated compound No. 2) obtained in Synthesis Example Polycarbonate resin (PanLite TS-2050, manufactured by Teijin Chemicals Ltd.):

Tetrahydrofuran: 48 parts

Example 2

The image bearing member 2 of the present disclosure is manufactured in the same manner as in Example 1 except that the liquid application for surface layer having the following recipe is used.

Liquid Application for Surface Layer

Furan derivative (Illustrated compound No. 2) obtained in Synthesis Example Polycarbonate resin (PanLite TS-2050, manufactured by Teijin Chemicals Ltd.):

Tetrahydrofuran: 48 parts

Example 3

The image bearing member 3 of the present disclosure is manufactured in the same manner as in Example 1 except that the liquid application for surface layer having the following recipe is used.

Liquid Application for Surface Layer

Furan derivative (Illustrated compound No. 1) obtained in Synthesis Example Polycarbonate resin (PanLite TS-2050, manufactured by Teijin Chemicals Ltd.):

Tetrahydrofuran: 48 parts

Example 4

The image bearing member 4 of the present disclosure is manufactured in the same manner as in Example 1 except that the liquid application for surface layer having the following recipe is used.

Liquid Application for Surface Layer

Furan derivative (Illustrated compound No. 5) obtained in Synthesis Example Polycarbonate resin (PanLite TS-2050, manufactured by Teijin Chemicals Ltd.):

Tetrahydrofuran: 48 parts

Example 5

The image bearing member 5 of the present disclosure is manufactured in the same manner as in Example 1 except that the liquid application for surface layer having the following recipe is used.

Liquid Application for Surface Layer

Furan derivative (Illustrated compound No. 9) obtained in Synthesis Example Polycarbonate resin (PanLite TS-2050, manufactured by Teijin Chemicals Ltd.):

Tetrahydrofuran 48 parts

Example 6

An undercoating layer and a charge generation layer having the same compositions and the thicknesses as in Example 1 are formed on an aluminum substrate (outer diameter: 30 mm ϕ). A liquid application for charge transport layer having the following recipe is applied to this charge generation layer by dip coating followed by drying at 120° C. for 30 minutes to form a transparent charge transport layer having a thickness of 20 nm.

Liquid Application for Charge Transport Layer

Charge Transport Material represented by the following chemical structure 10:

Chemical structure 10

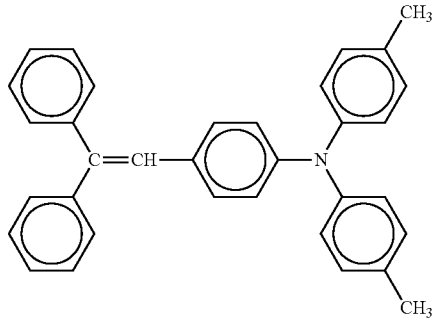

Polycarbonate resin (PanLite TS-2050, manufactured by Teijin Chemicals Ltd.):

Tetrahydrofuran: 48 parts

A liquid application for the surface layer having the following recipe is dip-coated on the charge transport layer to form a layer having a thickness of 5 μm after drying. The layer is processed with heat at 120° C. for 30 minutes to form a transparent surface layer having a charge transport function. The image bearing member 6 of the present disclosure is thus obtained.

Liquid Application for Surface Layer

Furan derivative (Illustrated compound No. 2) obtained in Synthesis Example Polycarbonate resin (PanLite TS-2050, manufactured by Teijin Chemicals Ltd.):

Tetrahydrofuran 48 parts

Example 7

An undercoating layer having the same composition and the thickness as in Example 1 is formed on an aluminum substrate (outer diameter: 30 mm ϕ). A liquid application for the surface layer having the following recipe is dip-coated on the undercoating layer to form a layer having a thickness of 25 μm after drying. The layer is processed with heat at 120° C. for 30 minutes to form a surface layer having a charge transport function and a charge generation function. The image bearing member 7 of the present disclosure is thus obtained.

Metal-free phthalocyanine having the following recipe is dispersed under the following conditions to prepare a liquid dispersion of pigment.

Metal-free phthalocyanine pigment (Fastogen Blue 8120B) manufactured by DIC Corporation) 3 parts Cyclohexanone 97 parts These are placed in a glass pot having a diameter of 9 cm and dispersed for five hours with PSZ balls having a diameter of 0.5 mm at 100 rpm to prepare the liquid dispersion of pigment.

A liquid of application for surface layer having the following recipe is prepared by using the liquid dispersion of pigment.

Liquid Application for Surface Layer

Liquid dispersion of pigment 6 parts

Charge transport material represented by the following chemical structure 11.

Chemical structure 11

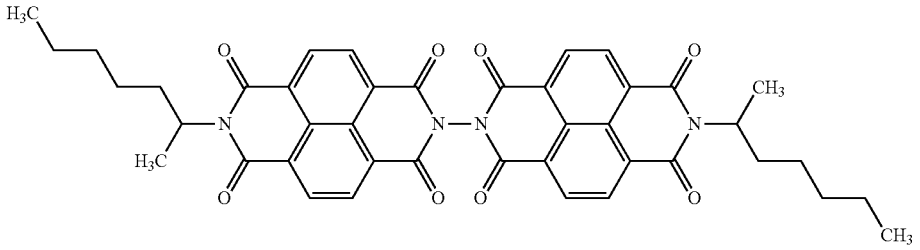

Furan derivative (Illustrated compound No. 2) obtained in Synthesis Example Polycarbonate resin (PanLite TS-2050, manufactured by Teijin Chemicals Ltd.):

Tetrahydrofuran 35 parts

Comparative Example 1

The image bearing member 8 of the present disclosure is manufactured in the same manner as in Example 1 except that the furan derivative in the liquid application for surface layer is changed to the charge transport material represented by the chemical structure 10.

Chemical structure 10

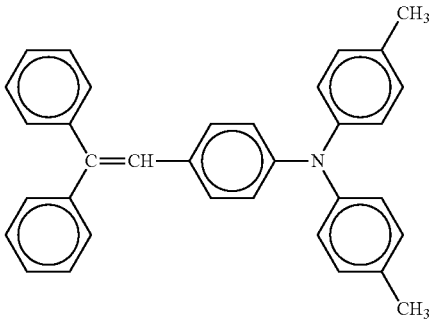

Comparative Example 2

The image bearing member 9 of the present disclosure is manufactured in the same manner as in Example 7 except that the furan derivative in the liquid application for surface layer is changed to the charge transport material represented by the chemical structure 10.

Chemical structure 10

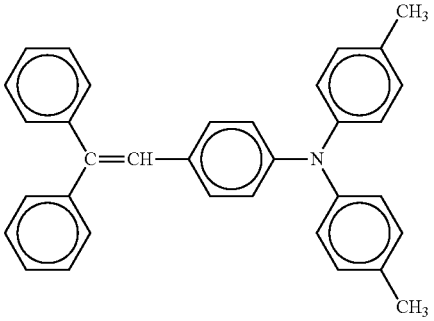

The surfaces of the image bearing members are checked by naked eyes with regard to cracking after the image bearing member is left in isopropyl alcohol gas having a density of 50 ppm for one week with regard to solvent cracking evaluation.

One of the image bearing members 1 to 6 is installed onto a photocopier (imagio MP1600, manufactured by Ricoh Co., Ltd.) employing reversal development and the image quality is evaluated after the initial printing and 40,000 printing. In addition, a surface electrometer is attached to the development position of imagio MP1600 to measure the surface voltage V1 at irradiated portions and the surface voltage Vd at non-image portions before starting the production of images and after 40,000 printing. The image bearing member 8 produces images with black streaks from the start. Therefore, printing 40,000 images using the image bearing member 8 is canceled. These results are shown in Table 1.

The image bearing member 7 is attached to an electrophotographic apparatus (remodeled based on imagio MP1600, manufactured by Ricoh Co., Ltd. The power pack is replaced for positive charging). The image quality is evaluated for the initially printed image and after 40,000 image production.

In addition, a surface electrometer is attached to the development position of imagio MP1600 to measure the surface voltage V1 at irradiated portion and the surface voltage Vd at non-image portion before starting the production of images and after 40,000 printing. The results of those are shown in Table 1.

The toner and the development agent dedicated for imagio MP1600 are replaced with those having a reverse polarity for use. The charging device of the image forming apparatus uses an external power source to apply a bias to the charging roller such that the charging voltage of the image bearing member at the start of the printing is +800 V and this charging condition is kept until the production is complete. The image bearing member 9 produces images with black streaks from the start. Therefore, printing 40,000 images using the image bearing member 9 is canceled.

TABLE 1

| | | Initial | | | After 40,000 photocopying | | |
|---|---|---|---|---|---|---|---|
| | Cracking | Vd (v) | Vl (v) | Image quality | Vd (v) | Vl (v) | Image quality |
| EX. 1 (IBM 1) | None | −810 | −130 | Good | −800 | −175 | Good |
| EX. 2 (IBM 2) | None | −820 | −155 | Good | −790 | −205 | Good |
| EX. 3 (IBM 3) | None | −805 | −135 | Good | −795 | −180 | Good |
| EX. 4 (IBM 4) | None | −815 | −140 | Good | −790 | −190 | Good |
| EX. 5 (IBM 5) | None | −820 | −135 | Good | −800 | −170 | Good |
| EX. 6 (IBM 6) | None | −805 | −125 | Good | −790 | −150 | Good |
| EX. 7 (IBM 7) | None | 810 | 135 | Good | 795 | 170 | Good |
| CE. 1 (IBM 8) | Yes | −840 | −130 | Defective image (black streak) | Unable to evaluate images | | |
| CE. 2 (IBM 9) | Yes | 810 | 120 | Defective image (black streak) | Unable to evaluate images | | |

EX: Example
IBM: Image bearing member
CE: Comparative Example

Having now fully described the invention, it will be apparent to one of ordinary skill in the art that many changes and modifications can be made thereto without departing from the spirit and scope of the invention as set forth therein.

What is claimed is:

1. An image bearing be comprising:

an electroconductive substrate;

a photosensitive layer provided overlying the electroconductive substrate; and a furan derivative represented by a following chemical structure 1, Chemical structure 1

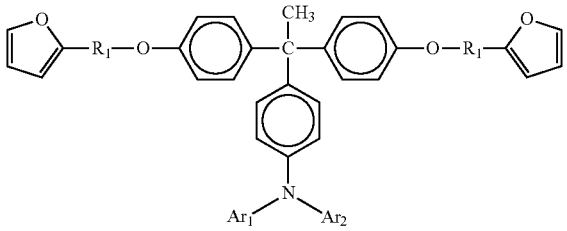

where $Ar_1$ and $Ar_2$ independently represent substituted or non-substituted aryl groups and $R_1$ represents an alkylene group having one to six carbon atoms, wherein the furan derivative is contained in the photosensitive layer.

2. The image bearing member according to claim 1, wherein the furan derivative is represented by a following chemical structure 2, Chemical structure 2

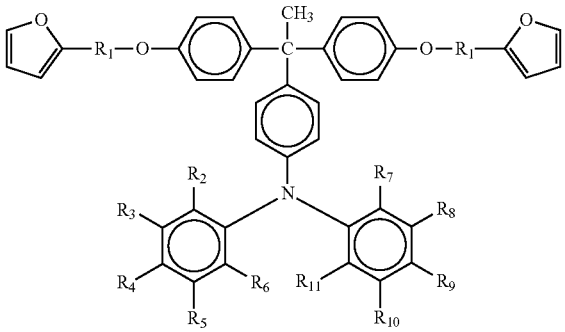

where $R_2$ to $R_{11}$ independently represent substituted or non-substituted alkyl groups having one to six carbon atoms, substituted or non-substituted alkoxy groups having one to six carbon atoms, or substituted or non-substituted aryl groups.

3. The image bearing member according to claim 1, wherein the furan derivative is represented by a following chemical structure 3, Chemical structure 3

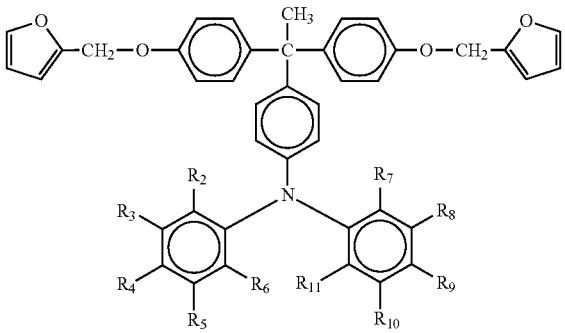

where $R_2$ to $R_{11}$ independently represent substituted or non-substituted alkyl groups having one to six carbon atoms, substituted or non-substituted alkoxy groups having one to six carbon atoms, or substituted or non-substituted aryl groups.

4. An image bearing member comprising:

an electroconductive substrate;

a photosensitive layer provided overlying the electroconductive substrate;

a surface layer provided overlying the photosensitive layer, which comprises a furan derivative represented by a following chemical structure 1, Chemical structure 1

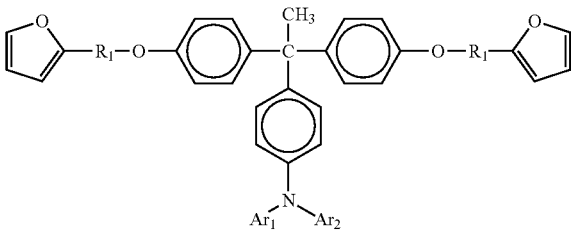

where $Ar_1$ and $Ar_2$ independently represent substituted or non-substituted aryl groups and $R_1$ represents an alkylene group having one to six carbon atoms.

5. The image bearing member according to claim 4, wherein the furan derivative is represented by a following chemical structure 2, Chemical structure 2

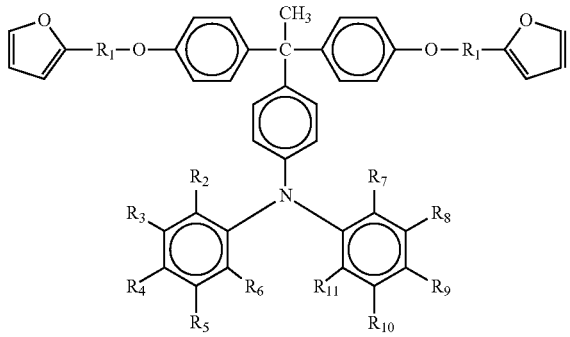

where $R_2$ to $R_{11}$ independently represent substituted or non-substituted alkyl groups having one to six carbon atoms, substituted or non-substituted alkoxy groups having one to six carbon atoms, or substituted or non-substituted aryl groups.

6. The image bearing member according to claim 4, wherein the furan derivative is represented by a following chemical structure 3, Chemical structure 3

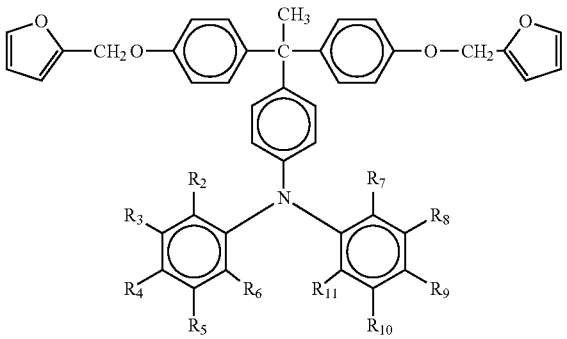

where $R_2$ to $R_{11}$ independently represent substituted or non-substituted alkyl groups having one to six carbon atoms, substituted or non-substituted alkoxy groups having one to six carbon atoms, or substituted or non-substituted aryl groups.

* * * * *